US005368536A

United States Patent [19]

Stodgell

[11] Patent Number: 5,368,536

[45] Date of Patent: Nov. 29, 1994

[54] ANKLE REHABILITATION DEVICE

[76] Inventor: Mark E. Stodgell, 4237 E. 50 N., Lafayette, Ind. 47905

[21] Appl. No.: 130,373

[22] Filed: Oct. 1, 1993

[51] Int. Cl.[5] ..... A63B 23/04

[52] U.S. Cl. ..... 482/79; 482/123; 482/130

[58] Field of Search ..... 482/79, 80, 111-113, 482/121-130

[56] References Cited

U.S. PATENT DOCUMENTS

| | | | |
|---|---|---|---|
| 3,638,941 | 2/1972 | Kulkens | 482/130 X |
| 3,782,721 | 1/1974 | Passera | 482/79 X |
| 3,984,100 | 10/1976 | Firster . | |
| 4,186,920 | 2/1980 | Fiore et al. . | |
| 4,199,137 | 4/1980 | Giguere . | |
| 4,306,714 | 12/1981 | Loomis et al. | 482/79 |
| 4,310,155 | 1/1982 | White . | |
| 4,337,939 | 7/1982 | Hoyle et al. . | |
| 4,452,447 | 6/1984 | Leplet et al. | 482/79 |
| 4,605,220 | 8/1986 | Troxel . | |
| 4,645,205 | 2/1987 | Wolff | 482/113 X |
| 4,650,183 | 3/1987 | McIntyre | 482/79 |
| 4,653,748 | 3/1987 | Seel et al. . | |
| 4,727,860 | 3/1988 | McIntyre | 482/79 X |
| 4,739,986 | 4/1988 | Kucharik et al. . | |
| 4,768,779 | 9/1988 | Oehman, Jr. et al. | 482/113 X |
| 4,998,720 | 3/1991 | Kim . | |
| 5,002,272 | 3/1991 | Hofmeister . | |
| 5,035,421 | 7/1991 | Scheller . | |

*Primary Examiner*—Richard J. Apley
*Assistant Examiner*—John Mulcahy
*Attorney, Agent, or Firm*—Woodard, Emhardt, Naughton, Moriarty & McNett

[57] ABSTRACT

An ankle rehabilitation device providing for exercise movement duplicating the complete range of ankle movement including plantar and dorsi flexion, inversion, eversion and rotation. The amount of resistance to movement and the direction of resistance may be changed without disattaching the foot from the device. A tensioning device is also provided to permit use of the device for isometric exercise of the ankle. An ankle rehabilitation device according to one embodiment of the invention comprises a base, a support post mounted to the base, a base plate rotatably mounted to the support post, a foot receiving platform universally mounted on top of the support post, and a two bar linkage mounted at one end to the base plate and at the other end to one of a plurality of attachment points on the foot receiving platform. A coilspring is operatively connected between the bars of the linkage.

7 Claims, 3 Drawing Sheets

ANKLE REHABILITATION DEVICE

BACKGROUND OF THE INVENTION

1. Field of the Invention

The present invention relates generally to the field of therapeutic rehabilitation devices and, more particularly, to devices facilitating exercise and rehabilitation of the ankle.

2. Description of the Prior Art

The ankle joint is capable of a wide range of motion. Such motion includes plantar flexion (moving the foot so that the toes go down), inversion (moving the bottom of the foot towards the midline of the body), eversion (moving the bottom of the foot away from the midline of the body), and rotation of the foot about a longitudinal or vertical axis. Because the ankle joint supports the entire weight of the body during upright movement it is at time subjected to severe stresses which can cause injury, especially during athletic type activities. Due to such circumstances, ankle joint injuries are among the most common injuries suffered by athletes.

As a consequence of an injury to the ankle joint, such as a sprain, strain or break, the soft tissues which encompass the joint, including muscles, ligaments, tendons and nerves, are often immobilized for a period of time and become weakened or atrophied. Thus, after the swelling and pair associated with the injury have diminished, it is important to rehabilitate the ankle to restore stability, range of movement, increase strength and recover neurological capacities necessary to its normal functioning. One way this is accomplished is by exercising the ankle through a desired range of movements on a device which is capable of providing a gradually increasing resistance to such movements.

Previous known devices designed for ankle rehabilitation may be characterized by the different tensioning structures used to oppose movement. Some devices provide movement in only one direction or in a very limited number of directions. Other devices lack a variable tensioning capability throughout the full range of motion. Yet others are difficult to adjust the direction of the resistance force and/or the level of resistance with the device attached to the user's foot. Also, many devices utilize weight plates or cylinders which only provide concentric resistance and not isometric or eccentric muscle contraction resistance. In addition, many devices are too bulky to offer easy user portability or are not adjustably sizable to accommodate a wide range of foot and ankle sizes.

SUMMARY OF THE INVENTION

An ankle rehabilitation device according to one embodiment of the present invention comprises a base, a foot receiving platform universally pivotably mounted to the base and including a plurality of attachment points extending around the perimeter of the platform, a fastening means for resisting pivotal movement of the platform. The resistance means is characterized by having an articulating linkage mounted at one end to the base and being releasably connectable at the other end to the plurality of attachment points. In addition, the resistance means includes an adjustment means for varying the resistance force generated by the resistance means.

It is an object of the present invention to provide an improved ankle rehabilitation device which addresses the previously described disadvantages of prior such devices.

It is further object of the present invention to provide an ankle rehabilitation device which provides a static contraction resistance capability as well as concentric and eccentric muscular contraction.

It is a yet further object of the present invention to provide an ankle rehabilitation device which allows the resistance force to be selectively limited to a desired direction of resistance corresponding to plantar and dorsi flexion, inversion, eversion and rotation movement. It is an additional object of the present invention to provide an ankle rehabilitation device which allows for adjusting tension and direction of resistance without having to remove the user's foot from the device.

Related objects and advantages of the present invention will become even more apparent by reference to the following figures and detailed description.

DESCRIPTION OF THE PREFERRED EMBODIMENT

Figure 1:
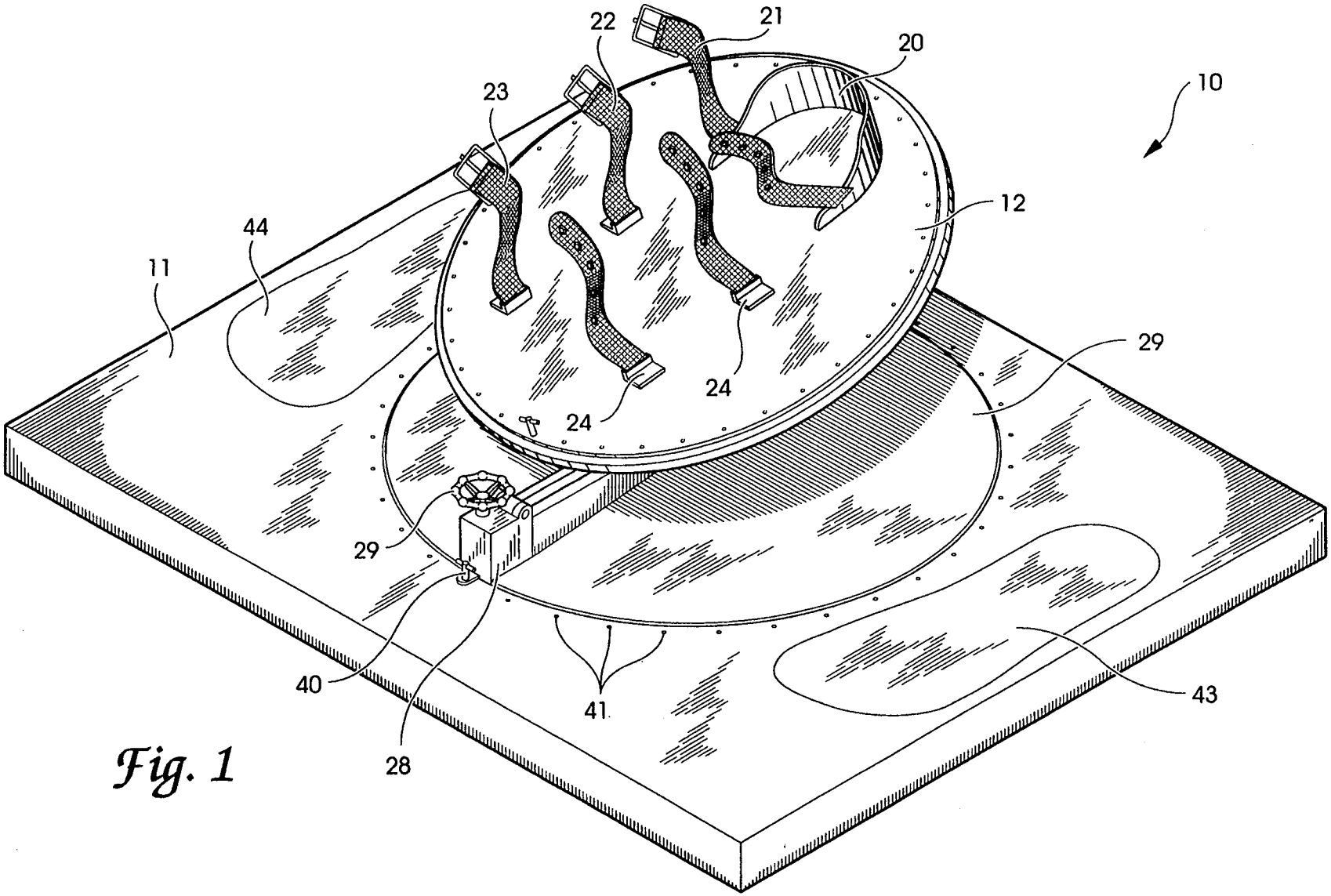
FIG. 1 is a perspective view of the ankle rehabilitation device of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
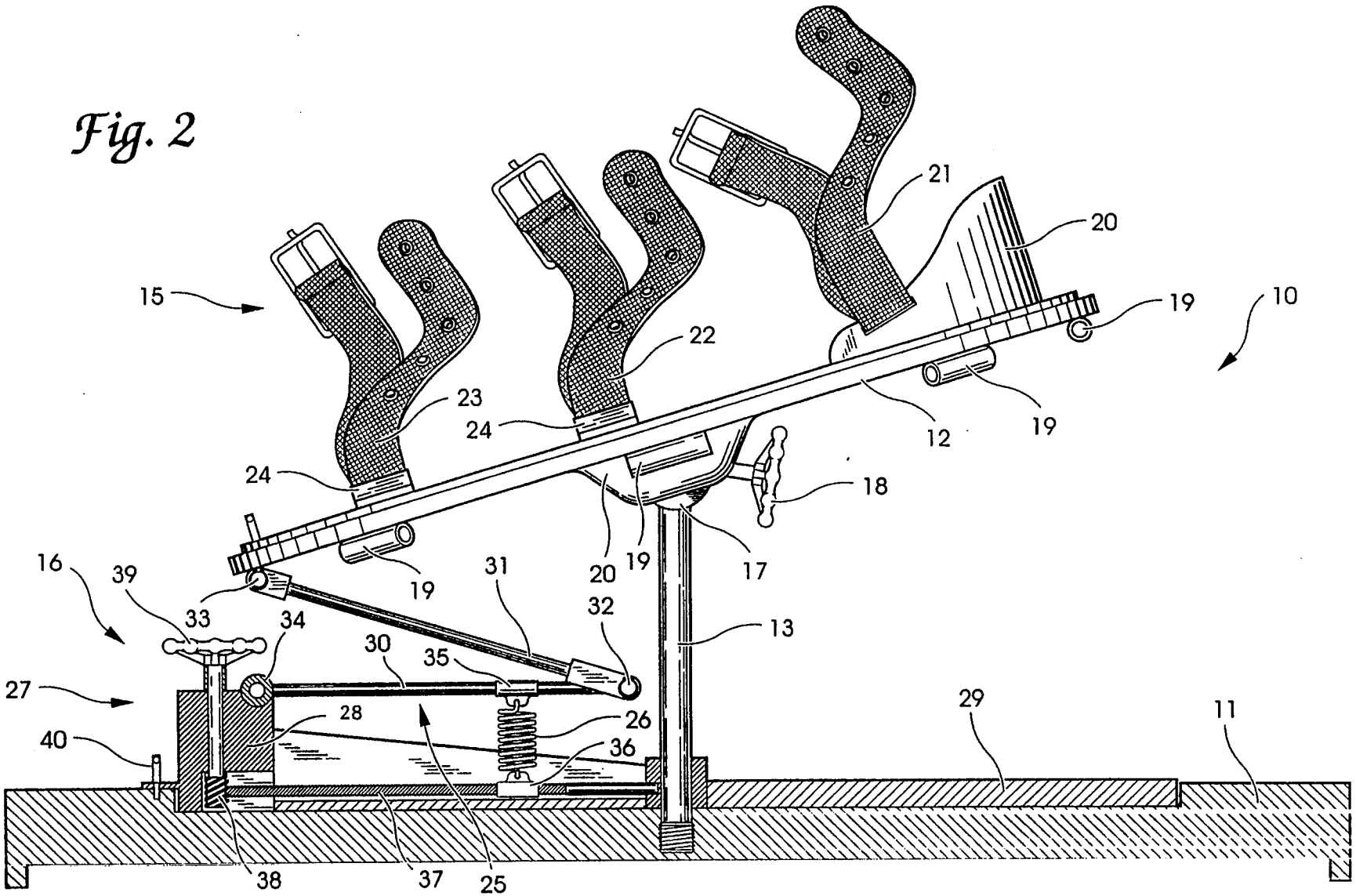
FIG. 2 is an elevation view, partially in section of the ankle rehabilitation device of FIG. 1.
Figure 3:
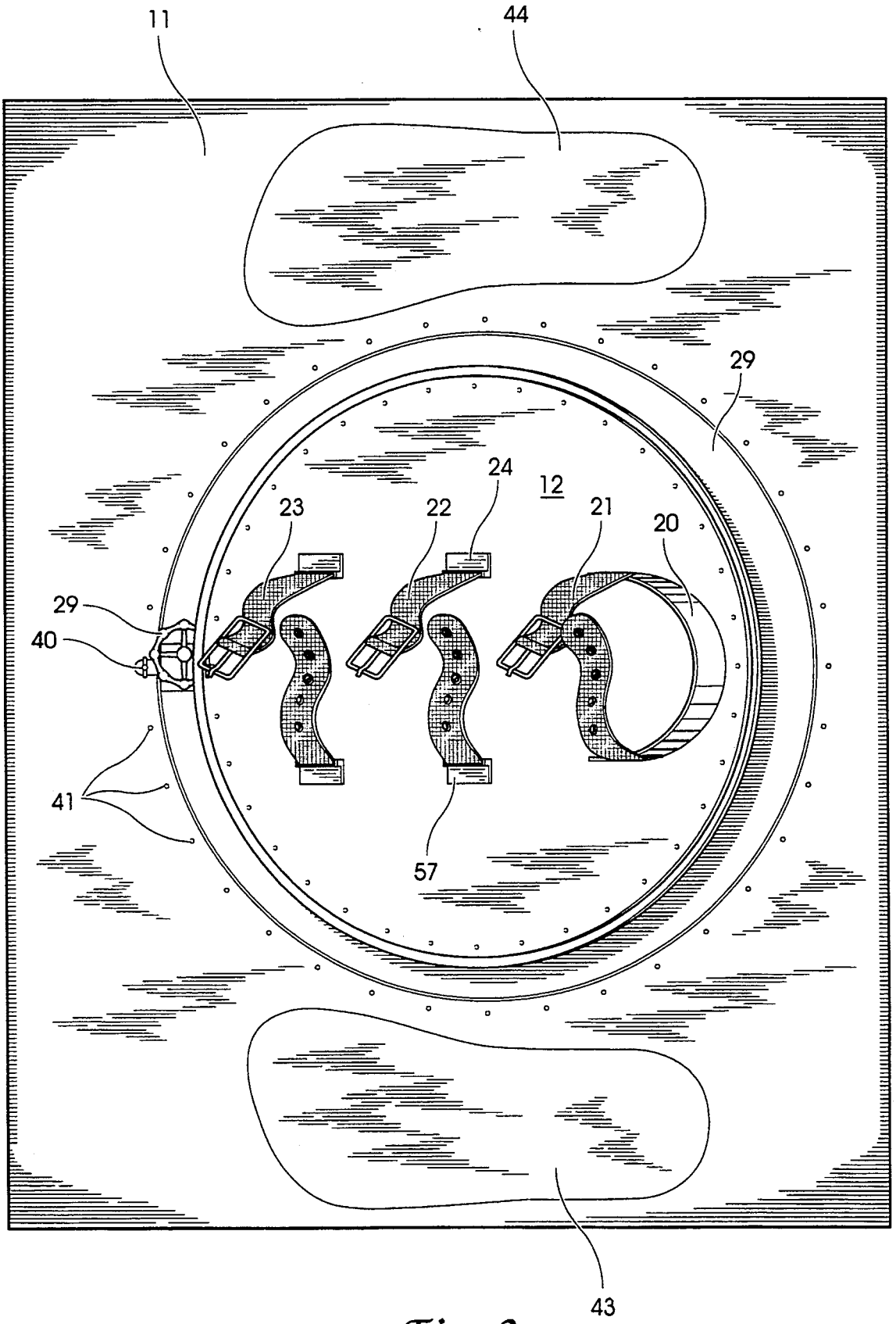
FIG. 3 is a top plan view of the ankle rehabilitation device of FIG. 1.

Referring now to the drawings in detail, there is depicted in FIGS. 1–3 the ankle rehabilitation device 10 of the present invention. The device 10 generally includes a base 11, a circular shaped foot receiving platform 12, a foot fastening means 15, and a resistance means 16 for resisting pivotal movement of the platform 12. Foot receiving platform 12 is universally pivotably mounted to base 11 by way of a ball joint 17 received with a housing 20 secured to the underside of foot platform 12. Ball joint 17 is mounted to the upper end of an upstanding post 13 which is rigidly mounted at the lower end to base 11. A tensioning screw 18 permits adjustable tensioning of the resistance to movement of the foot platform 12 on the ball joint 17.

The foot receiving platform 12 includes on its underside a plurality of tubular shaped sleeves 19 which serve as attachment points extending around the perimeter of the platform 12 at equally radially spaced apart locations corresponding to plantar flexion, dorsi flexion, inversion and eversion movement of a foot secured to the platform 12. In the preferred embodiment there are eight sleeves 19, although a greater or lesser number could also be employed if desired.

Foot fastening means 15 includes a heel support 20 upon which is secured belt-type fastener straps 21 for adjustably securing the heel portion of the foot. Additional fastener straps 22 and 23 serve to anchor the mid and forward portions of the foot and are mounted on slides 24 which permit their location to be moved forwardly or away from heel support 20 to accommodate feet of different lengths. The foot fastening means 15 is positioned on the platform 12 such that ball joint 17 will allow a foot secured on the foot platform 12 to universally pivot on an axis which conforms to the normal axis of biomechanical movement of the ankle joint. It should be understood that while not shown, a similar slide or other type adjustment mechanism could be provided for the heel support 20 as well.

Resistance means 16 generally includes an articulating two bar linkage 25, coilspring 26 and tensioning adjustment mechanism 27. The adjustment mechanism 27 is received within a housing 28 rigidly mounted to an extending upwardly from a circular shaped base plate 29 rotatably mounted on base 11. The two bar linkage 25 includes bars 30 and 31 which are pivotally coupled together at joint 32. The end of bar 31 opposite joint 32 is releasably coupled to a selected on of the plurality of sleeves 19 and is secured thereto by pin 33. Although secured to sleeve 19 by pin 33, bar 31 is free to pivot on the axis of sleeve 19. In turn, the end of bar 30 opposite joint 32 is pivotably coupled to housing 28 at joint 34. Coilspring 26 is secured at the upper end to a sleeve 35 slidably received on bar 30 and at the lower end to an internally threaded sleeve 36 engaged over threaded rod 37. A worm gear 38 engages complimentary gear teeth on threaded rod 37 and is rotated by manipulation of knob 39.

The relative lengths of bars 30 and 31 may be varied in order to vary the force/distance profile of the tensioning device as may be desired for optimum rehabilitation purposes.

Base plate 29 is rotatably received on base 11 and rotates on the axis of upstanding post 13. A pin 40 serves to secure the position of platter 29 in any selective one of the pin mounting holes 41 located at a plurality of radially spaced part locations corresponding to selected pints for providing resistance to ankle movement.

Foot locations 43 and 44 are marked on the base 11 for indicating desired placement locations of the non-involved foot in order to steady the device during use.

In operation, the user's involved foot is positioned onto the foot platform 12, the locations of the straps adjusted relative to the heel support 20 according to the foot size, and the foot is securely strapped into place. If the user desires to accomplish isometric exercise of the ankle, the tensioning screw 18 is tightened against ball joint 17 to maintain the foot platform 12 in a static position during exercise. If the user desires to accomplish concentric and eccentric muscular contraction exercise of the ankle, the tensioning screw 18 is loosened and the desired direction of ankle movement is selected. With the two bar linkage 25 disconnected from the foot platform 12, the base plate 29 is rotated until the linkage 25 is properly aligned with a selected one of the sleeves 19. Bar 31 is then coupled to the selected sleeve 19 and base plate 29 is secured in position relative to base 11 by inserting pin 40 through a selected corresponding mounting hole 41 in base 11. Tension on the two bar linkage 25 is adjusted by manipulation of knob 39 which activates the worm gear assembly to rotate threaded rod 37 and thereby move the coilspring 26 to the left or right as seen in FIG. 2. Rightward movement of the coilspring 26 serves to increase the tensioning, whereas leftward movement decreases the tensioning force necessary to pivot foot platform 12 through a given range of movement. In order to begin exercising with a different direction of tensioning force, it is only necessary to disconnect the bar 31 and base plate 29, rotate the base plate to its desired new position, reconnect bar 31 and base plate 29, and readjust tensioning as desired.

It should be appreciated that the rotatably base plate 29 permits changing the direction of the tensioning force without actually having to either change the user's position or reorient the base 11. This allows the user to avoid having to unfasten and re-fasten the user's foot on foot platform 12.

While the invention has been illustrated and described in detail in the drawings and foregoing description, the same is to be considered as illustrative and not restrictive in character. For example, the two bar linkage could be designed as a three or more bar linkage, tensioning devices other than a coilspring could be employed, the base plate could be shaped to extend only partially around upstanding post 13, Velcro TM straps or snaps could be employed as opposed to belt type straps, etc. Thus, it should be understood that only the preferred embodiment has been shown and described and that all changes and modifications that come within the spirit of the invention are described to be protected.

What is claimed is:

1. An ankle rehabilitation device, comprising:

a base;

a foot receiving platform including a plurality of attachment points extending around the perimeter of said platform;

a support post rigidly mounted to said base and universally coupled to said platform, said base including a base plate rotatably mounted to said support post;

a fastening means for fastening a foot to said platform;

a resistance means for resisting pivotal movement of said platform, said resistance means including an articulating linkage mounted at one end to said base plate and releasably connectable at the other end to one of said plurality of attachment points, said resistance means further including an adjustment means for varying the resistance force generated by said resistance means.

2. The ankle rehabilitation device of claim 1 wherein said articulating linkage is a two bar linkage.

3. The ankle rehabilitation device of claim 2 wherein said fastening means is adjustable to accommodate different length feet.

4. The ankle rehabilitation device of claim 2 wherein said bars have different lengths.

5. An ankle rehabilitation device, comprising:

a base a foot receiving platform including a plurality of attachment points extending around the perimeter of said platform;

a support post rigidly mounted to said base and universally coupled to said platform, said base including a base plate rotatably mounted to said support post;

a fastening means for fastening a foot to said platform;

a resistance means for resisting pivotal movement of said platform, said resistance means including an articulating linkage mounted at one end to said base plate and releasably connectable at the other end to one of said plurality of attachment points, said resistance means further including an adjustment means for varying the resistance force generated by said resistance means;

wherein said attachment points are located at positions corresponding to plantar flexion, dorsi flexion, inversion and eversion movement of a foot secured to said platform.

6. The ankle rehabilitation device of claim 5 wherein said articulating linkage is a two bar linkage.

7. The ankle rehabilitation device of claim 6 wherein said fastening is adjustable to accommodate different length feet.

* * * * *